US005675088A

United States Patent [19]

Serata

[11] Patent Number: 5,675,088

[45] Date of Patent: Oct. 7, 1997

[54] METHOD AND APPARATUS FOR AUTOMATIC MONITORING OF TECTONIC STRESSES AND QUANTITATIVE FORECAST OF SHALLOW EARTHQUAKES

[76] Inventor: Shosei Serata, 3640 Ridgewood Way, Richmond, Calif. 94806

[21] Appl. No.: 557,362

[22] Filed: Nov. 13, 1995

Related U.S. Application Data

[63] Continuation-in-part of Ser. No. 415,196, Apr. 3, 1995, Pat. No. 5,576,485.

[51] Int. Cl.[6] ..... G01N 33/24; G01B 7/24; E21B 47/00; G01V 1/00

[52] U.S. Cl. ..... 73/784; 73/152.59; 73/152.17; 73/152.02; 166/207; 166/271; 166/250; 367/14

[58] Field of Search ..... 73/151, 152, 783, 73/784; 367/14, 25; 166/101, 207, 212, 271, 250; 152/152.54, 152.59, 152.17, 152.02

[56] References Cited

U.S. PATENT DOCUMENTS

| | | | |
|---|---|---|---|
| 2,812,025 | 11/1957 | Teague, et al. | 166/207 |
| 3,477,506 | 11/1969 | Malone | 166/207 |
| 3,796,091 | 3/1974 | Serata | 73/88 E |
| 4,149,409 | 4/1979 | Serata | 73/151 |
| 4,314,338 | 2/1982 | Suau et al. | 364/422 |
| 4,461,171 | 7/1984 | de la Cruz | 73/151 |
| 4,491,022 | 1/1985 | de la Cruz | 73/783 |
| 4,599,904 | 7/1986 | Fontenot | 73/783 |
| 4,628,299 | 12/1986 | Tate et al. | 340/540 |
| 4,641,520 | 2/1987 | Mao | 73/151 |
| 4,733,567 | 3/1988 | Serata | 73/784 |
| 4,858,130 | 8/1989 | Widrow | 364/421 |
| 4,899,320 | 2/1990 | Hearn et al. | 367/35 |
| 5,060,204 | 10/1991 | Winterstein | 367/75 |
| 5,381,690 | 1/1995 | Kanduth et al. | 73/151 |

*Primary Examiner*—Hezron E. Williams
*Assistant Examiner*—J. David Wiggins

[57] ABSTRACT

An apparatus for measuring in situ stresses surrounding an active earthquake fault and forecasting shallow earthquakes includes a network of monitoring stations, each operating a respective borehole assembly for measuring in situ lateral stresses. The monitoring stations are arrayed along a recognized fault plane and arranged to straddle the fault plane, so that lateral stress readings may be obtained throughout the ground media surrounding the fault zone. All of the monitoring stations communicate with a central data-gathering facility, so that real-time analysis of changes in lateral stress orientation and magnitude surrounding the fault zone may be undertaken, and the results used to forecast forthcoming seismic events. Each borehole probe assembly includes a trio of single fracture expansion probes operated periodically, reiteratively, and automatically to expand against the borehole wall and determine the principal maximum and minimum lateral stress vectors in the underground media. The assembly is suspended in the borehole by a wireline that provides electronic communications with a ground level monitoring station. Each probe assembly includes an anchor section that secures the assembly in the borehole at a selected and variable depth, and provides a stable base for a rotator section that rotates the expansion probes to any selected angle about the borehole axis. The ground level monitoring station includes a data communication link to transmit borehole data to a central office and to receive operational commands.

19 Claims, 10 Drawing Sheets

Contour Map of Maximum Stress at Locked Section of Typical Active Fault

Contour Map of Shear Stress at Locked Section of Typical Active Fault

METHOD AND APPARATUS FOR AUTOMATIC MONITORING OF TECTONIC STRESSES AND QUANTITATIVE FORECAST OF SHALLOW EARTHQUAKES

REFERENCE TO RELATED APPLICATION

This application is a continuation-in-part of United States patent application Ser. No. 08/415,196, filed Apr. 3, 1995, now U.S. Pat. No. 5,576,485 titled Single Fracture Method and Apparatus for Simultaneous Measurement of In-Situ Earthen Stress State and Material Properties, which is incorporated herein by reference.

BACKGROUND OF THE INVENTION

This invention relates to the study of earthen stress conditions that cause earthquakes, and more particularly to apparatus and method for monitoring such stresses and forecasting shallow earthquakes.

Recent advancements in geophysics in general and seismology in particular have disclosed the fundamental mechanism of earthquakes based on plate tectonics. Oceanic and continental plates are colliding along continental margins on a global scale, and this process is specially noted along the so-called rim of fire that comprises the shores of the Pacific Ocean. It has also been learned that earthquakes may be categorized in two distinct types: deep earthquakes which are caused by the direct collision of tectonic plates, and shallow earthquakes which are caused by the build-up of lateral tectonic stresses along shallow active faults which overlay areas of tectonic collision. These faults are scars of past shallow earthquakes, which tend to re-occur in cycles that are erratic.

Deep earthquakes are generally very large in magnitude, but their destructive power is not as great as shallow earthquakes, due to the fact that their shock energy is diffused broadly over a large area before it reaches the surface. Fortunately, modern structures are designed to withstand most of the impact from deep earthquakes. It is the shallow earthquakes which are most devastating to structures and people, even if the structures are built to meet the highest standards of earthquake resistant design.

Despite many advances in instrumentation, and notwithstanding many large-scale fault monitoring projects sponsored by national governments, the ability to predict earthquakes with any meaningful reliability and immediacy has eluded seismologists and geologists. Many active fault zones have been studied on an on-going basis with magnetometers, mean-stress sensors, and strain gauges extending across the fault zones. Even in cases where earthquakes have occurred along instrumented faults, a review of the instrument readings prior to the seismic event has failed to reveal meaningful correlations that could be used to predict seismic events in the future.

Thus, the state of the art is that it is not possible to predict when, where, and how large a forthcoming major earthquake may be, regardless of which geophysical methodology (or combination thereof) is used. Even a slight hope for a limited possibility of forecasting earthquakes has been disproved by studies conducted in the past decade, yielding no hope for developing a quantitatively reliable, rather than statistically reliable prediction method. With no clear choice of methodology nor any specific hope of success, the national research budget for earthquake studies has been significantly reduced in recent years in the United States.

SUMMARY OF THE INVENTION

The present invention generally comprises a method and apparatus for measuring in situ stresses surrounding an active earthquake fault and forecasting shallow earthquake based on verifiable data and sound engineering principles.

Contrary to the difficulties of prior art geophysical approaches, the present invention is based on a proven method of geotechnical engineering. More specifically, the underlying concept of the method is to measure the driving force of shallow earthquakes directly; that is, the lateral tectonic stresses and their areal distribution as well as their time-dependent changes. The invention is significant in that it yields a realistic, real-time analysis of the current degree of earthquake danger in any given area by measuring the lateral tectonic stresses in the area. Furthermore, it encompasses monitoring the time-dependent process of earthquake stress build-up in highly quantitative engineering terms, and compares the stress build-up to the intrinsic strength of the materials and structure of the particular fault zone. This comparison is used to warn of impending shallow earthquakes, which tend to be the most destructive in terms of lives and property damage.

The apparatus of the invention comprises, in one aspect, a borehole probe assembly that is particularly designed for measuring lateral stresses in underground media. The probe assembly includes a trio of single fracture expansion probes that are operated periodically and reiteratively to expand against the borehole wall and determine the magnitudes and orientations of the principal maximum and minimum lateral stress vectors in the three dimensional underground media. The assembly is suspended in the borehole by a wireline that provides electronic communications with a ground level monitoring station. In addition, the assembly includes an anchor section that secures the assembly in the borehole at a selected and variable depth, and provides a stable base for a rotator section that rotates the expansion probes to any selected angle about the borehole axis. The assembly further includes a multiple fracture expansion probe that is operated in conjunction with a set of at least three single fracture probes to verify data therefrom.

The ground level monitoring station includes a data communication link, such as a telephone or satellite link, to communicate borehole data to a central office and to receive operational commands. The station incorporates a wireline power winch to suspend and move the probe assembly to any selected depth within the borehole, and a hydraulic hose power winch to supply on command high pressure hydraulic fluid to the expansion probes. The wireline is connected to a transceiver and data communication unit, which not only processes and transmits data from the borehole probes, but also receives commands and instructions from a data link. A power and hardware control unit provides electrical power to the station, and also supplies high pressure hydraulic fluid to the borehole probes upon command. The system is designed to operate either autonomously to actuate the borehole probes and acquire data on a periodic basis, or to operate upon command from a central station through communication on the data link.

In another aspect, the apparatus of the invention includes a network of monitoring stations, each operating a respective borehole assembly for measuring in situ lateral stresses. The monitoring stations are arrayed along a recognized fault plane and arranged to straddle the fault plane, so that lateral stress readings may be obtained as a continuing function of time throughout the three dimensional ground media surrounding the fault zone. All of the monitoring stations communicate with a central data-gathering facility, so that real-time analysis of changes in lateral stress orientation and magnitude along the fault zone may be undertaken, and the results used to forecast forthcoming seismic events.

In another aspect, the apparatus includes an improved single fracture borehole probe that is designed to be used reiteratively for continuous underground stress monitoring. The probe includes a central mandrel having an axial bore to provide fluid flow therethrough, and a flexible, elastic expansion sleeve surrounding the mandrel that is inflatable by fluid pressure provided by the mandrel. Secured to the outer surface of the expansion sleeve are a pair of semicylindrical friction members that are confronting along a reference plane that extends through the axis of the mandrel, so that the expansion member inflates outwardly to fracture the borehole wall along the reference plane.

The probe further includes an end cap secured to one end of the mandrel and extending about the adjacent end of the expansion sleeve. A seal assembly is secured annularly about the portion of the expansion sleeve that interfaces with the end cap. The seal assembly comprises an annular body tapered at each end and formed of elastic polymer that is harder than the expansion sleeve and softer than the steel end cap. Embedded in the seal body are a plurality of reinforcing members, each comprising a pair of cylindrical disk-like members spaced apart axially and joined by a rod member extending axially therebetween. Each reinforcing member acts as a self-locking anchor with respect to the end cap, and the reinforcing members are arrayed in tight annular spacing about the body of the seal assembly. A pair of helical springs are also embedded in the seal body, each extending annularly in one end of the seal body to assure structural integrity.

The internal anchoring effect of the reinforcing members at the outer end of the seal prevents any plastic media from being squeezed out by the high internal loading pressure. Moreover, the like outer ends of the internal anchors are disposed within the confines of the end cap, so that they may pivot outwardly therefrom to accommodate expansion sleeve inflation while preventing blowout or rupture of the sleeve itself.

DESCRIPTION OF THE PREFERRED EMBODIMENT

The present invention generally comprises a method and apparatus for measuring in situ stresses surrounding an active earthquake fault and forecasting shallow earthquake based on verifiable data and sound engineering principles.

Figure 1:
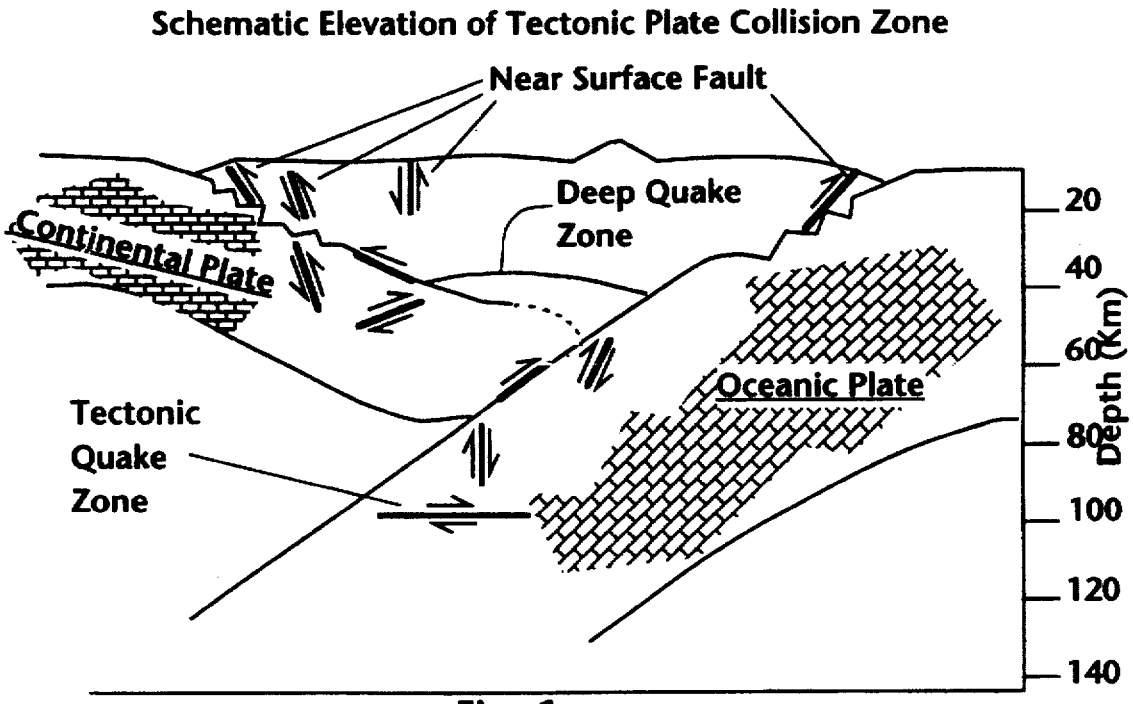
FIG. 1 is a representative schematic elevation of a tectonic plate collision zone, showing deep and near surface fault areas.

One aspect of the invention comprises a method for continuously monitoring lateral stress fields in areas adjacent to a fault zone, and examining the variations in stress magnitude and direction over time to forecast an impending major, near-surface seismic event. With regard to FIG. 1, it is generally recognized that collisions of deep tectonic plates, such as a continental plate and an oceanic plate, cause the build-up of underground stress anomalies that ultimately result in seismic activity. The tectonic collision zone is tens to hundreds of kilometers deep, and tectonic earthquakes caused by direct crustal plate collision may occur in depths of 50–100 km or more. The colliding plates carry with them the overlying rock media, which undergoes movement and distortions resulting in the build-up of underground stresses. These stresses cause surface and near surface faults, generally at depths less than 20 km, as well as faults in a deep quake zone that is adjacent to the upper edge of the tectonic collision zone.

Generally, earthquakes caused by the surface and near surface faults are by far the most destructive, due to their proximity to buildings and structures at the surface. In contrast, seismic events in the tectonic quake zone or the deep quake zone may release more energy, but this energy is diffused broadly through the rock media before it reaches the surface, generally resulting in far less destruction. The present invention is directed primarily at the devastating shallow earthquakes caused by surface and near surface faults.

The inventor has discovered that a certain characteristic stress anomaly develops along an active fault before an occurrence of an earthquake. The mechanism of earthquake stress build-up prior to a final break and slip along the fault, which comprises an earthquake, was analyzed using a finite element computer modeling technique. For computational purposes, the Hayward Fault of the San Francisco Bay region was used as an example of a typical fault for modeling purposes. This fault has sections which appear to be locked, as well as sections that exhibit numerous low magnitude seismic events that indicate sliding interaction between colliding masses.

Due to the highly constant intrinsic sliding speed of the colliding tectonic plates, tectonic stresses must be concentrating and building up at the locked sections of a fault. Although tectonic stresses form a three-dimensional field in the underground media surrounding a fault zone, most fault planes are substantially vertical or divergent from vertical within a nominal range, and the primary stresses are perpendicular to the fault plane. That is, lateral tectonic stresses are the fundamental causative agent in most shallow earthquakes, and are the main concern in earthquake study and prediction.

Figure 2:
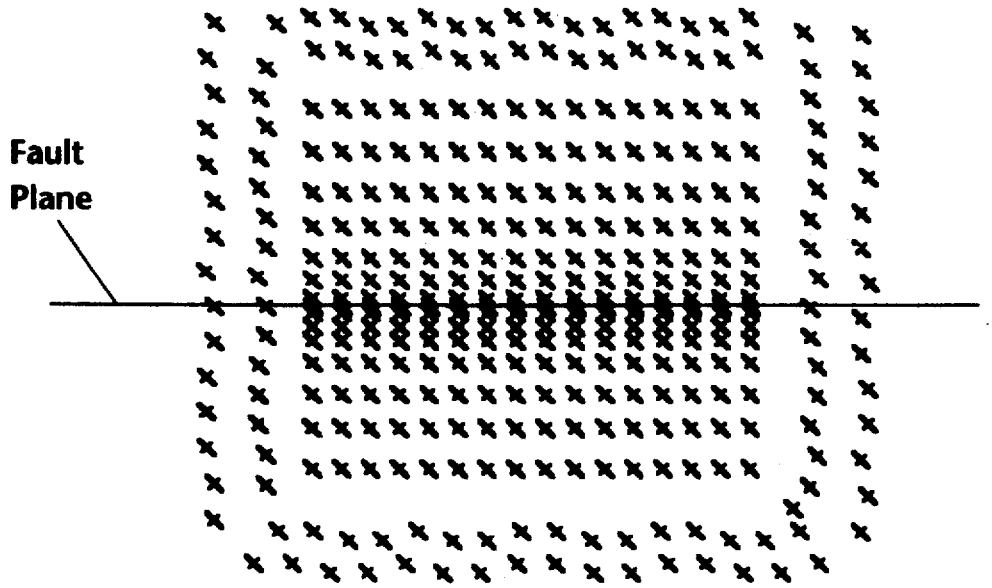
FIG. 2 is a plot of the principle maximum and minimum lateral stress vector field surrounding a sliding (unlocked) portion of a shallow earthquake fault.
Figure 3:
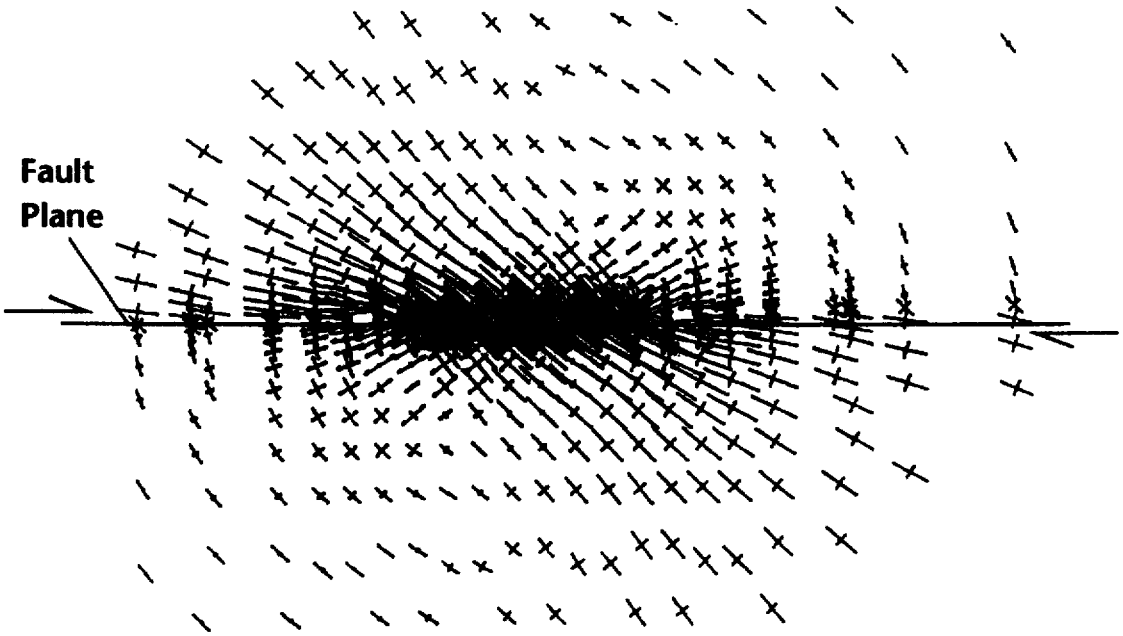
FIG. 3 is a plot of the principle maximum and minimum lateral stress vector field surrounding a locked portion of a shallow earthquake fault.

As shown in FIGS. 2 and 3, the results of finite element analysis of a sliding fault section (FIG. 2) are compared graphically with a locked fault section (FIG. 3) by depicting the horizontal distribution of the lateral tectonic stresses $\sigma_H^T$ and $\sigma_h^T$ at a depth of one kilometer. The stress distribution of the sliding section is generally uniform in direction and magnitude, whereas the locked section exhibits a stress field having marked variations or distortions in direction and magnitude. This characteristic stress anomaly found around a locked fault section comprises the earthquake stresses which are directly responsible for triggering a sudden failure of the locked section of the fault plane, resulting in the occurrence of a shallow, devastating earthquake as experienced recently in Kobe, Japan, and Northridge, Calif. Given proper instrumentation, the anomalies in stress distribution and orientation depicted in FIG. 3 may be detected readily.

These acting earthquake stresses are defined by the following engineering terms:

Acting vertical stress ($\sigma_v$)=vertical stress acting on a horizontal plane;

Acting maximum lateral stress ($\sigma_H$)=maximum stress in the horizontal plane;

Acting minimum lateral stress ($\sigma_h$)=minimum stress in the horizontal plane.

The stresses which are directly responsible for the occurrence of a shallow earthquake may be defined independent of depth by a set of equations that express the principal stresses found in the ground:

Vertical stresses ($\sigma_v$)=$\rho H$

Max. lateral tectonic stress ($\sigma H^T$)=$\sigma_H - \nu\rho H$

Min. lateral tectonic stress ($\sigma_h^T$)=$\sigma_h - \nu\rho H$

Where: H=depth of the overburden $\rho$=average unit weight of overburden $\nu$=average effective Poison's ration (=0.25 of overburden)

Figure 5:
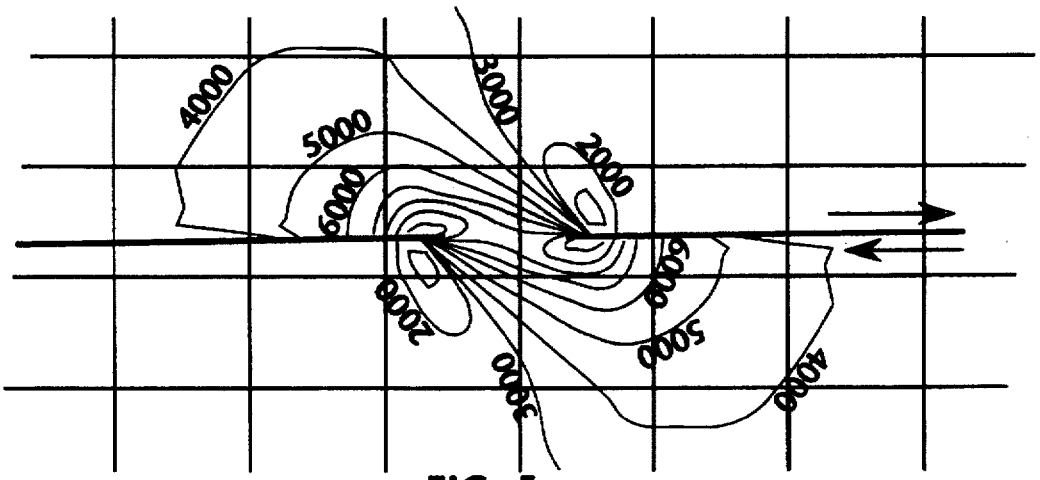
FIG. 5 is a contour plot of maximum lateral stress surrounding a locked portion of a typical active shallow earthquake fault.
Figure 4:
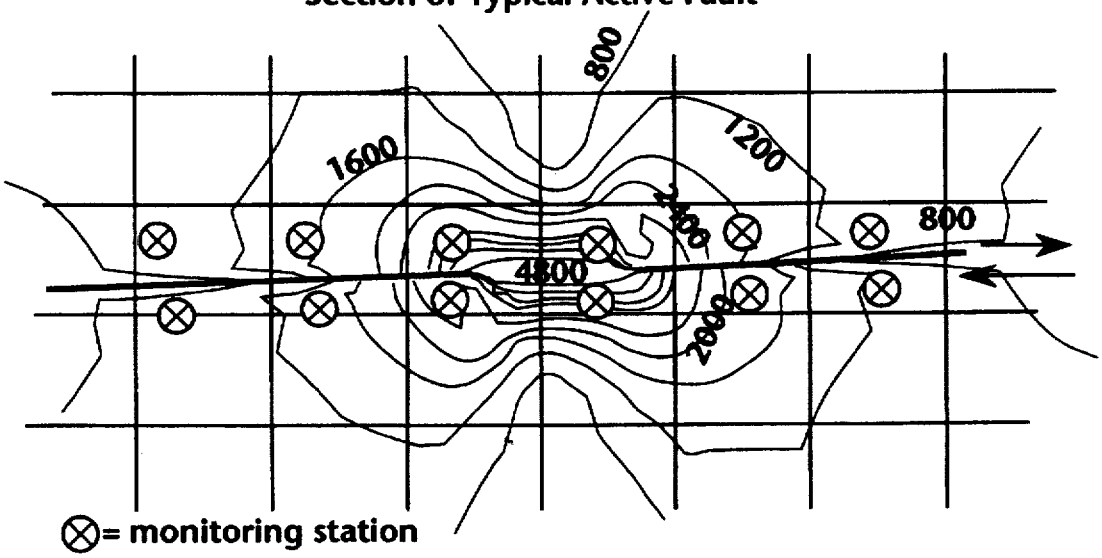
FIG. 4 is a contour plot of lateral shear stress surrounding a locked portion of a typical active shallow earthquake fault.

The finite element computer analysis of lateral stresses discloses a high concentration of shear stresses around the locked section of a fault plane, as shown in FIG. 4. Likewise, the maximum lateral stresses around the locked section exhibit a skewed symmetry and very high values, as shown in FIG. 5.

Figure 6:
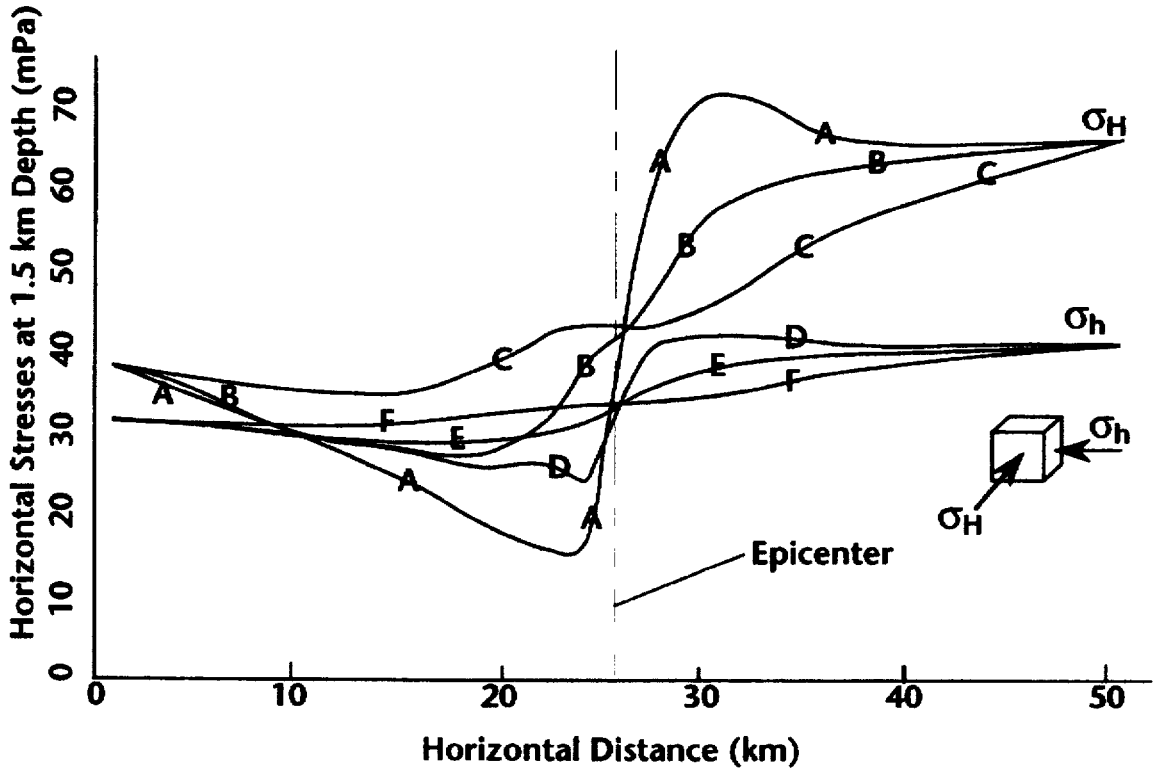
FIG. 6 is a graphical depiction of principal lateral stress vector magnitudes as a function of distance from an earthquake epicenter in relation to three different epicenter depths

A finite element computer analysis of areal distribution of lateral stresses around a fault plane was used to evaluate the effect of depth of an earthquake epicenter upon the stress distribution around the epicenter as depicted in FIG. 6. The model shows how lateral stress anomalies measured at a 1500 meter depth can be related to different epicenter depths such as 3000 m (graph A), 5000 m (graph B), and 9000 m (graph C). This shows that the principle maximum and minimum lateral stresses measured at a shallow depth, as shown in FIG. 6, can be used to determine depth of the epicenter. This finding indicates that the location of a deeper epicenter can be detected directly by measuring the areal distribution of stress anomalies at a shallower depth. Thus it is shown to be valid that lateral stress measurement at shallow depths can detect stress buildup leading to the deepest of shallow earthquakes (at or below 10 km depth).

Figure 7:
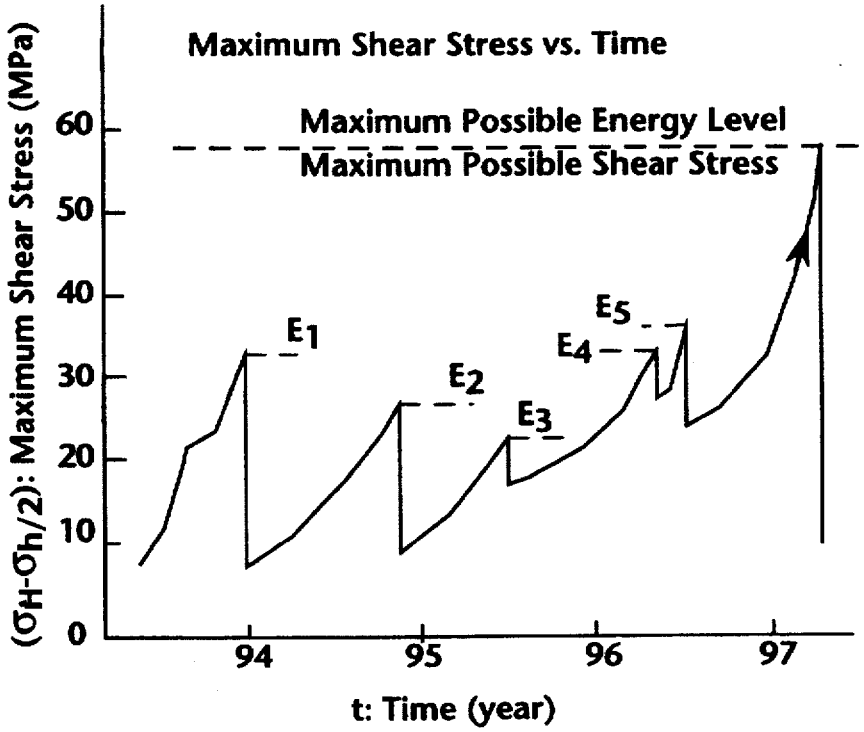
FIG. 7 is a graphical depiction of maximum lateral shear stress with respect to time, showing the time process of major earthquake stress energy buildup leading to its occurrence.

The computer model further discloses the degree of earthquake potential along a fault plane, due to the fact that the upper limit of the stress build-up before its final rupture can be related to both the maximum shear strength of the fault plane and the magnitude of the earthquake energy in relation to progression of time. FIG. 7 depicts the relation of maximum shear stress to time, and indicates that the typical time-dependent build-up of earthquake stresses can be closely related to the mechanical process of rock failure, leading to low level seismic events ($E_1$–$E_5$), and also to the ultimate devastating earthquake, in direct, quantitative engineering terms. A measurement result such as FIG. 7 can be used to generate a site-specific relation of fault behavior necessary for prediction of a major earthquake. Therefore, it is not only possible, but also realistic to make quantitative predictions of an occurrence of a significant shallow earthquake, assuming that accurate measurement of earthquake stresses over time may be obtained.

Conventional seismic research has been directed toward accurate measurement of tectonic stresses at greater depths. Instruments have been placed at depths exceeding 4000 m at great cost and effort, only to find that the tectonic stresses cannot be measured there. Two major difficulties are encountered at great depths, one natural and one artificial. The natural obstacle is a failure of ground material due to an increase in the difference between the vertical and lateral stresses, and the artificial obstacle is the failure of the borehole boundary materials due to the borehole drilling made in the highly compressed ground at greater depths. These difficulties become increasingly serious starting at depths below 2000 m, even in relatively hard rock media.

A key finding underlying the method of the invention is the discovery of a window of observation for shallow lateral tectonic stresses within the earthen media around a fault zone at relatively shallow depths. The present inventor has discovered fundamental properties of lateral tectonic stresses that permit measurement of these stresses at depths that are relatively easy to attain with available drilling technology. These properties are as follows:

1) Constant Rate of Stress Increase: The depth gradient of all the acting lateral stresses are found to be generally constant at the following theoretical value everywhere in the ground regardless of the depth and rock properties:

$$\begin{aligned}\Delta\sigma/\Delta H &= \text{(lateral stress change)/(overburden stress change)}\\ &= \text{depth gradient of stresses}\\ &= \nu/(1-\nu) \cong 0.20\end{aligned}$$

2) Constant Lateral Tectonic Stresses: The lateral tectonic stresses are found to be constant, having uniquely site specific values within individual rock strata regardless of the depth.

3) Shifting of Constant Values of Stresses: The constant values of lateral tectonic stresses in shallower formations tend to shift to greater values abruptly at the interface of the strata with increasing depth.

4) Asymptotic Saturation of Stresses: The constant lateral tectonic stresses found in the individual strata increase in deeper strata approaching a highly site-specific saturation value at a depth of approximately 500 m.

Figure 8:
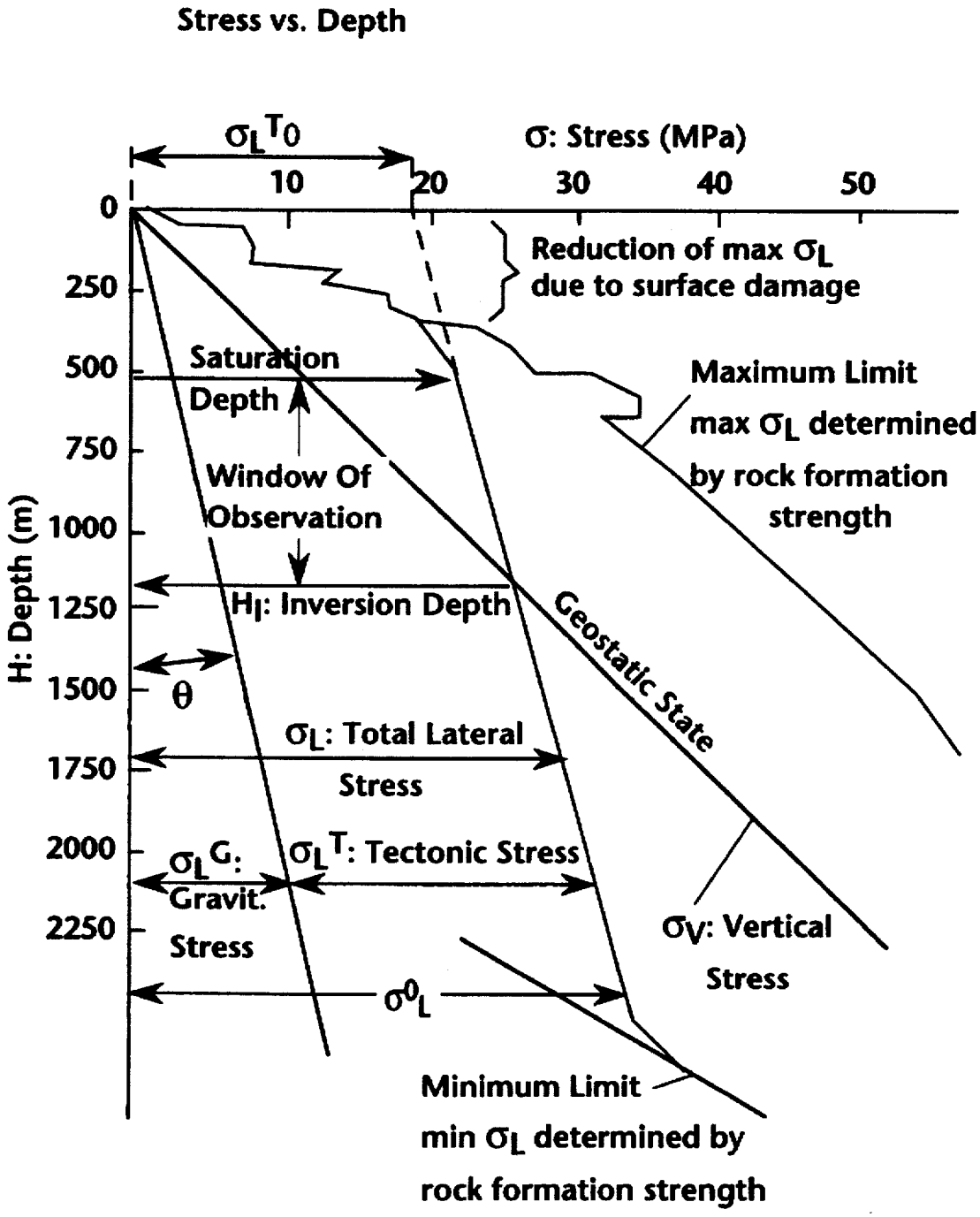
FIG. 8 is a schematic plot of underground stress components with respect to depth, showing the window of observation of the invention.

These properties were determined through observations in a number of underground mining and construction sites made with the apparatus disclosed in the copending patent application noted above. Furthermore, the same properties have been confirmed by examining the ten best earth stress measurement studies conducted worldwide in the past two decades, using mainly the hydrofracture technique. The analysis is represented by the graphic plot of stress versus depth of FIG. 8. The plot of lateral gravitational stress $\sigma_L^G$ extends from the origin in a linear relationship extending at an angle θ having a tangent equal to the constant ratio of the gravitational stress to depth. The lateral tectonic stress $\sigma_L^T$ comprises the added horizontal stress in the shallow rock media due to the collision of deep, underlying tectonic plates. The lateral tectonic stress $\sigma_L^T$ may be resolved as the principal major and principal minor stress vectors $\sigma_H^T$ and $\sigma_h^T$. The lateral tectonic stress added to the gravitational stress equals the total lateral stress $\sigma_L$, the plot of which extends parallel to the gravitation stress $\sigma_L^G$, also at the same angle θ. The plot of vertical stress $\sigma_v$ also extends from the origin at an angle representing the geostatic state, and the intersection of the vertical stress $\sigma_v$ and total lateral stress $\sigma_L$ defines a depth identified as the inversion depth. The inversion depth, which is typically found at approximately 1000–1500 m, forms a general lower boundary to the window of observation.

It is also noted that the total lateral stress $\sigma_L$ increases from the origin in an irregular manner until it achieves a linear relationship at a minimum depth identified as the saturation depth. The saturation depth corresponds to the depth of the site specific lateral tectonic stress $\sigma_L T_O$. The saturation depth, which is typically found at approximately 500 m, corresponds to the upper limit of the window of observation, due to the fact that the media above the saturation depth generally suffers from disruption due to near-surface geological processes. Likewise, below the inversion depth the vertical stresses begin to overwhelm the lateral stress field and reduce the resolution of stress readings. Thus, the window of observation typically extends from 500 m to 1500 m, yielding a 1000 m range in which readings may be taken.

The significance of the window of observation is that it is sufficiently shallow to permit access by common drilling techniques. Also, the shallow depth of the window avoids higher ambient temperatures at great depths, permitting the use of computer electronics in the measurement instruments. Any borehole may be examined with a borehole probe (described below) to take a series of readings at incremental depths to determine the site-specific saturation depth and inversion depth.

The present invention further includes automated apparatus for exploiting the window of observation to make direct measurements of the lateral tectonic stress field in the area of a fault zone. The invention provides a network of measuring stations, each situated in a respective borehole adjacent to a fault zone and operated reiteratively to detect variations over time in the magnitude and direction of the principal maximum and minimum lateral stresses around the fault zone.

Figure 9:
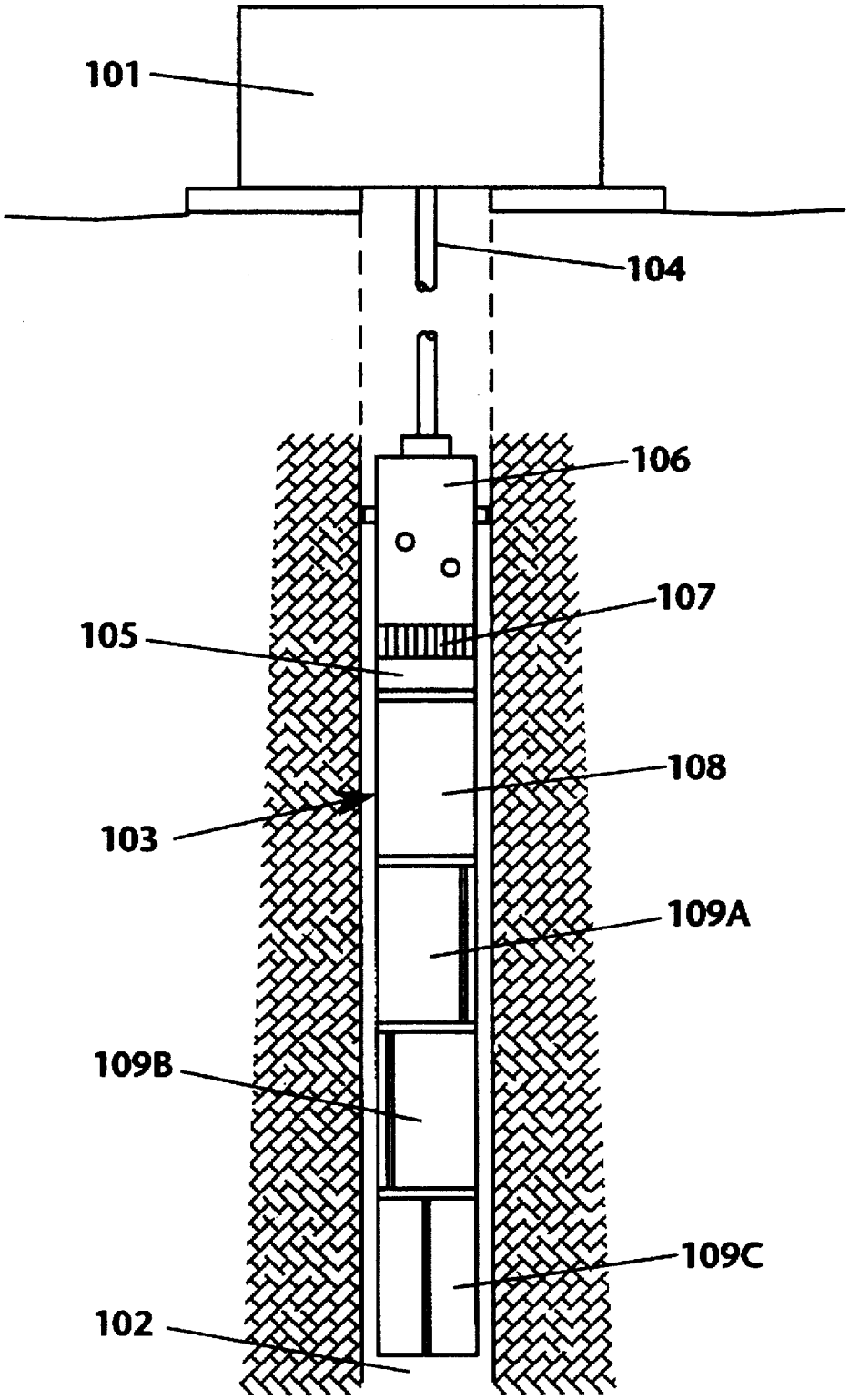
FIG. 9 is a schematic elevation of a typical automated borehole stress monitoring station constructed in accordance with the present invention.

With regard to FIG. 9, each automated stress monitoring station 101 is located over a borehole 102, and a borehole probe assembly 103 is placed in the borehole 102 within the window of observation depth range. Suspended by a wire or cable 104, the probe assembly 103 includes an anchor unit 106 at its upper end for centering the unit in the borehole. A rotator neck 107 is secured to the anchor unit, and an electronic chamber 105 is secured to the rotator neck 107. A multiple fracture expansion probe 108, such as the apparatus described in U.S. Pat. No. 4,733,567, issued Jul. 11, 1988 to Shosei Serata, is supported in depending relationship from the electronic chamber 105.

Depending from the unit 108 is a trio of single fracture expansion probes 109A, 109B, and 109C, as described in the copending patent application noted in the reference to related applications. The probes 109 are adapted to create fractures in the borehole media at defined vertical planes, and these vertical planes diverge at 60° intervals about the axis of the probe. These probes are operated reiteratively and automatically under control of the surface station 101 at selected time intervals to expand and fracture the borehole media, and the correlation of the probe pressure with fracture expansion yields accurate data on the tensile strength and principal maximum and minimum lateral stress vectors at the borehole. The rotator neck 107 permits great selectivity in setting the angles of the fracture planes of the probes 109, and the readings of the multiple fracture probe 108 are used to confirm or question the data from the probes 109.

Figure 10:
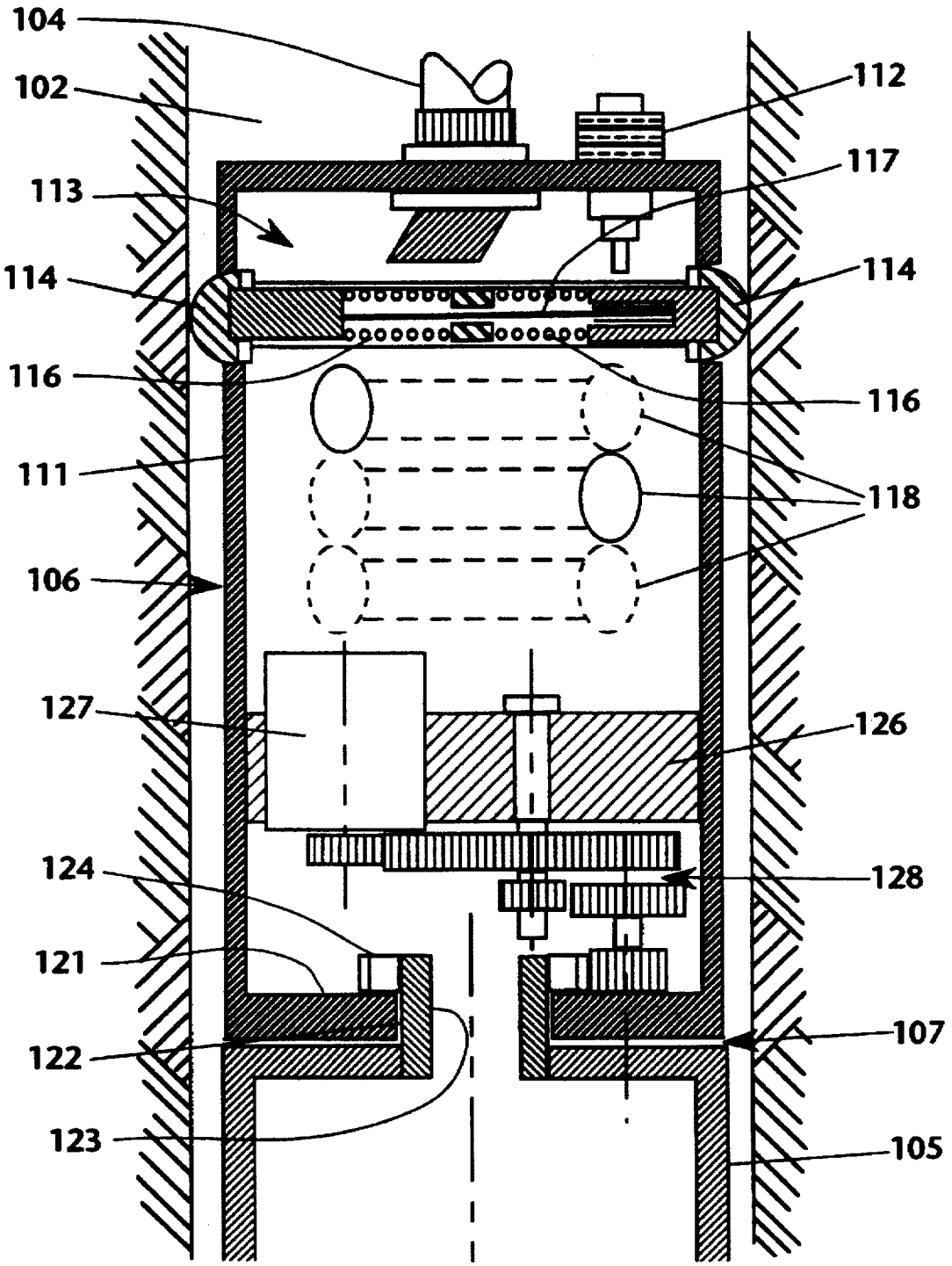
FIG. 10 is an enlarged cross-sectional view of the anchor/caliper section of the borehole probe assembly of the invention.

With regard to FIG. 10, the anchor unit 106 includes a tubular housing 111 having a closed upper end, with connections to the cable or wireline 104 and to a hydraulic pressure line 112. An anchor caliper assembly 113 is secured in the housing 111, including opposed, diametrically extendable heads 114 adapted to impinge on the borehole wall. The heads 114 are resiliently biased outwardly by a pair of springs 116 to impinge on the borehole wall. An LVDT 117 is secured between the heads to provide highly accurate measurements of the borehole diameter and to warn of borehole collapse or failure. Additional caliper assemblies 118, each provided with an LVDT sensor, are arrayed vertically and diverge at regular angular intervals about the axis of the unit to extend therefrom to the borehole wall and measure the borehole diameter all around the borehole. The additional calipers also maintain centering of the housing 111 with respect to the borehole.

The lower end of the tubular housing 111 includes an end wall 121 having a central opening 122 therein. The upper end of the electronics chamber 105 includes an upwardly extending neck 123 received through the opening 122 in freely rotating fashion. A drive gear 124 is secured about the neck 123 within the anchor unit 106 to secure the units 105 and 106 together. An electric motor 127 is supported on a strut 126 in the anchor unit 106, and is connected through a gear reduction assembly 128 to the drive gear 124. The motor is actuated selectively to rotate the electronics chamber 105 and the probes 108 and 109 depending therefrom, and the calipers 113 and 118 provide a static base for rotation.

Figure 11:
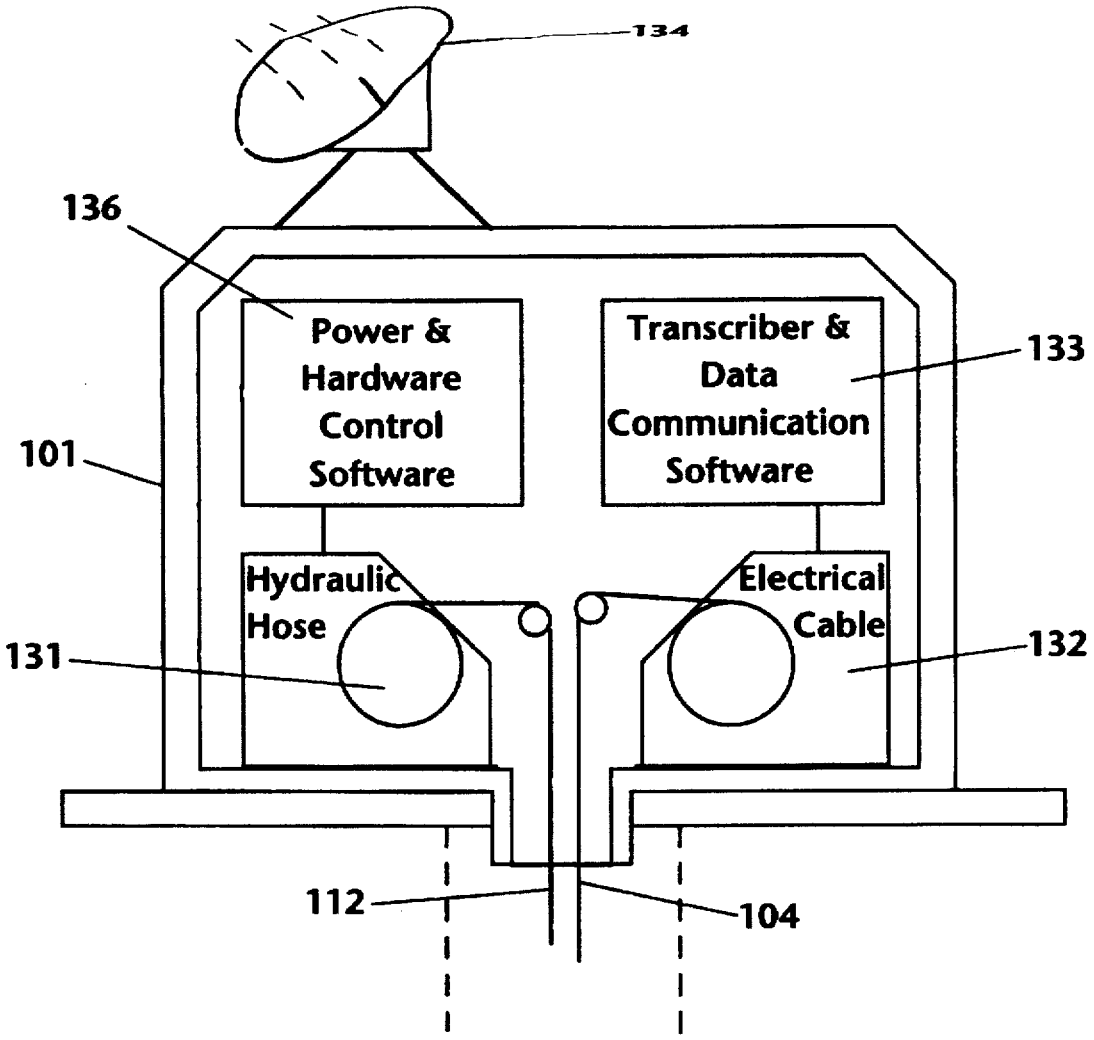
FIG. 11 is a functional block diagram of the monitoring station of the invention.

With regard to FIG. 11, the automated stress monitoring station 101 includes a power winch 131 for storing, feeding and retrieving the hydraulic hose line 112, and a power winch 132 for storing, feeding and retrieving the cable or wireline 104. The wireline is connected to a transceiver and data communication unit 133, not only processes and transmits data from the borehole probes, but also receives commands and instructions from a data link 134. A power and hardware control unit 136 provides electrical power to the station, and also supplies high pressure hydraulic fluid to the borehole probes upon command. The system is designed to operate either autonomously to actuate the borehole probes and acquire data on a periodic basis, or to operate upon command from a central station through communication on the data link 134.

Each of the probes 109 is constructed generally as set forth in the related copending United States Patent application Ser. No. 08/415,196, filed Apr. 3, 1995, titled Single Fracture Method and Apparatus for Simultaneous Measurement of In-Situ Earthen Stress State and Material Properties, with the exceptions noted below and depicted in FIGS. 12–14.

Figure 13:
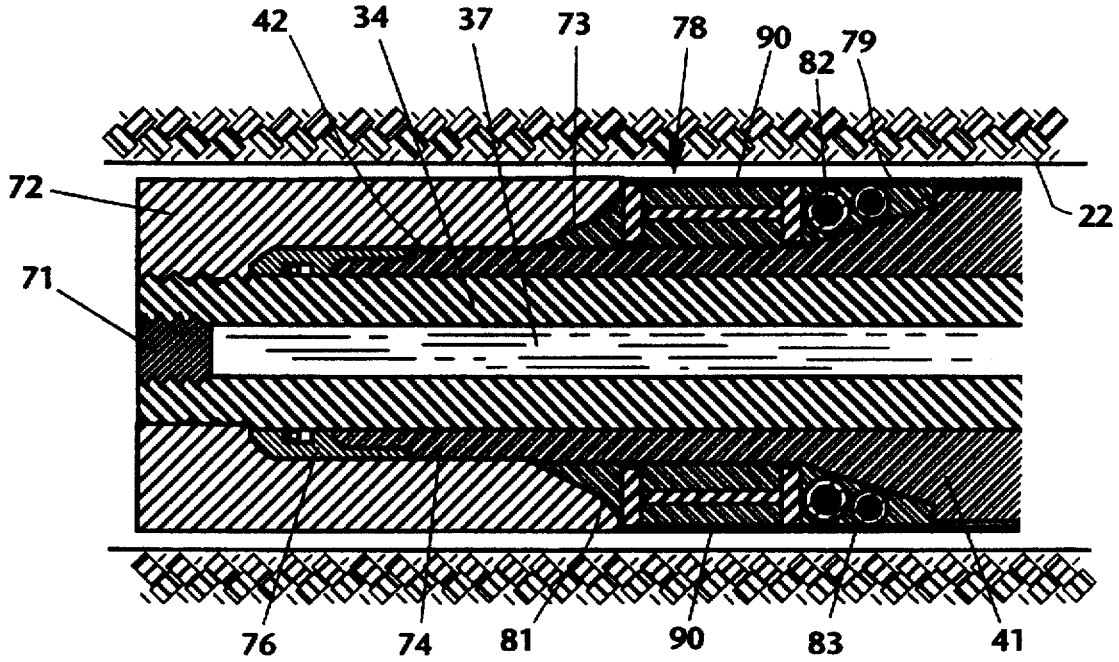
FIG. 13 is an enlarged cross-sectional side view of one end seal of a single fracture borehole probe, shown in the retracted, deflated disposition.

Referring to FIG. 13, the probe includes a central mandrel 34 having an axial bore 37 to provide fluid flow therethrough, and a flexible, elastic expansion sleeve 41 surrounding the mandrel 34 that is inflatable by fluid pressure provided through the bore 37. Secured to the outer surface of the expansion sleeve 41 are a pair of semi-cylindrical friction members 40 that are confronting along a reference plane that extends through the axis of the mandrel, so that the expansion sleeves member 41 inflates outwardly to fracture the borehole wall 22 along the reference plane. Rotation of the probe by the motor 127 can select the precise angle of reference plane with respect to the borehole axis.

The probe further includes a cup-shaped steel frontal end cap 72 secured by threads to the outer surface of the frontal end of the mandrel 34, and includes an inwardly flaring portion 73. The expansion sleeve 41 includes a tapered frontal end 74 that is received between the frontal end of the mandrel 34 and the interior of the frontal end cap 72. A bushing 76 is secured within the end cap 72 by cement bonding at the termination of the member 41, and supports an O-ring seal to prevent fluid loss from the interstitial space 42 through the threaded end of the mandrel.

Figure 12:
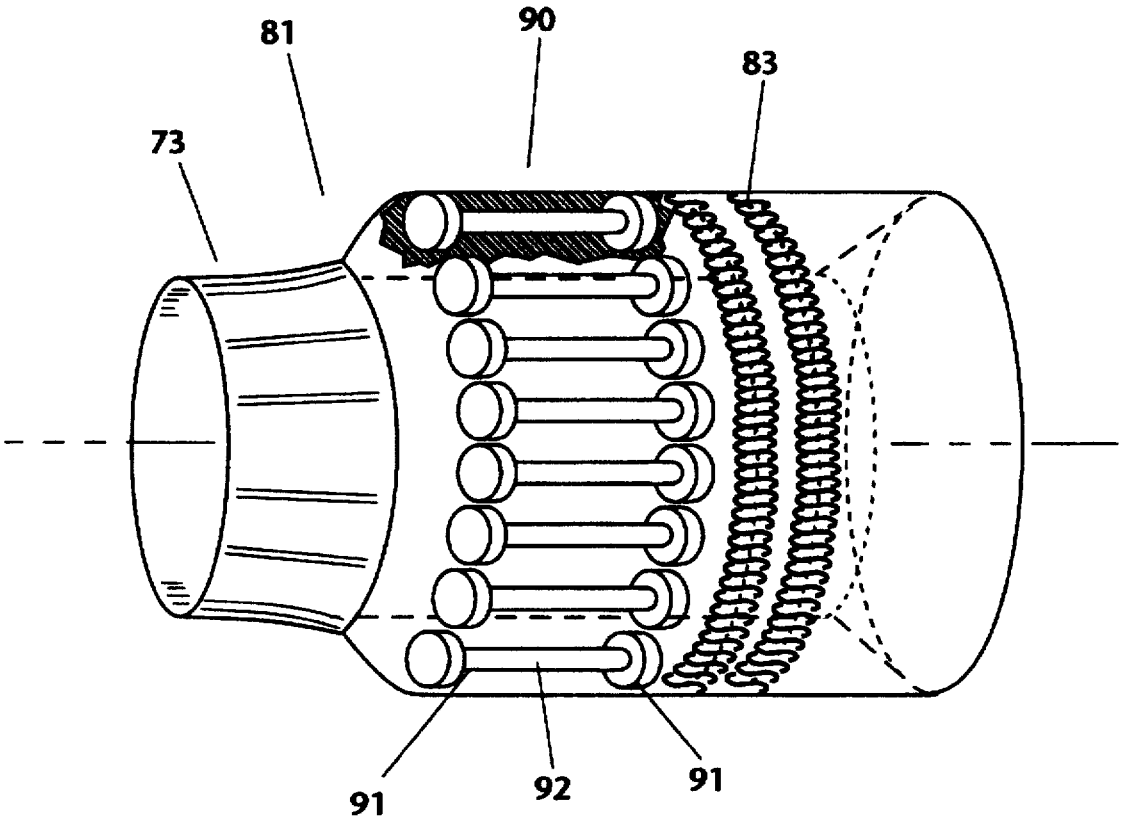
FIG. 12 is a partially cutaway perspective view of the end seal of one single fracture borehole probe of the invention.
Figure 14:
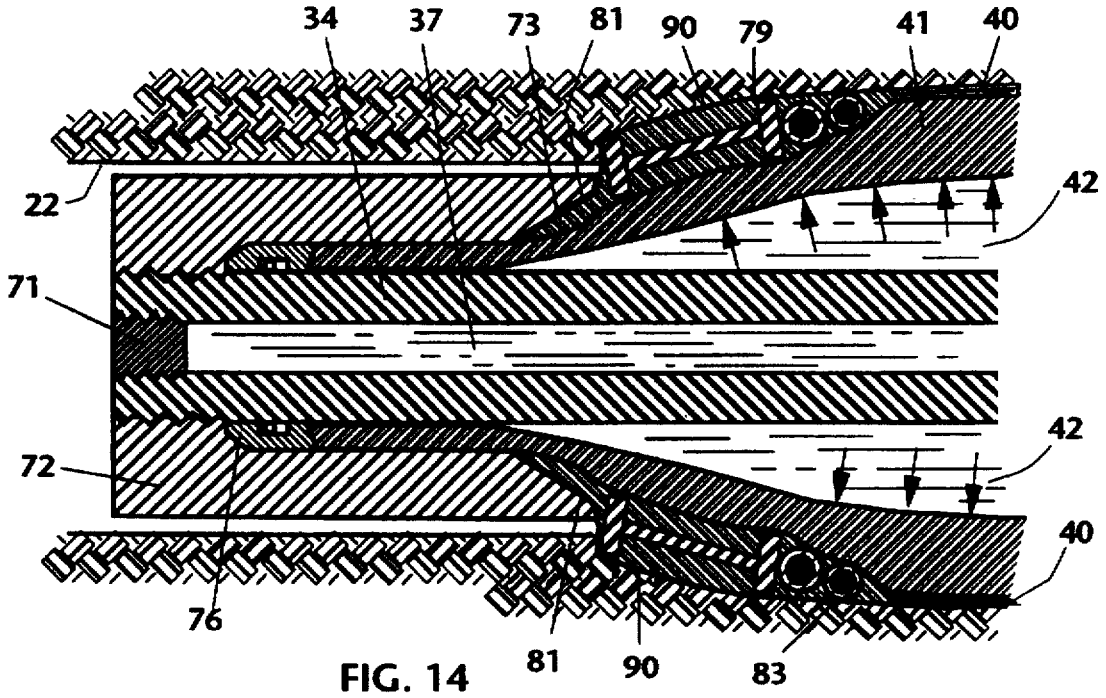
FIG. 14 is an enlarged cross-sectional side view of one end seal of a single fracture borehole probe, shown in the extended, inflated disposition.

A seal assembly 78, isolated in FIG. 12, is secured annularly about the portion of the expansion sleeve that interfaces with the end cap. The seal assembly 78 is formed of an elastic polymer material that is relatively harder than the member 41 and softer than the end cap 72, and is provided as a transition between the expandable member 41 and the rigid end cap 72. That is, the seal assembly 78 protects the member 41 during expansion from damage or rupture, by preventing extrusion or plastic deformation of the member 41 at the end cap conjunction, as depicted in FIG. 14. The seal assembly 78 is provided with a wedge-shaped cross-sectional configuration which impinges conformally both on the flared end 73 of the end cap and on the tapered surface 74 of the member 41. The inner and outer surfaces of the seal assembly 78 are provided with high strength (Kevlar or equivalent) fiber reinforcement 79 bonded to the polymer material thereof. The fibers 79 are oriented longitudinally to permit circumferential expansion of the seal while restricting longitudinal expansion.

A pair of helical coil springs 82 and 83 are embedded in annular fashion at the inner end of the seal within the polymer body material. As shown in FIG. 14, during inflation of the expansion member 41 the tapered end 81 of the seal retains the outer end of the seal 78 within the flared end 73 to maintain the sealing integrity of the assembly of the loading section. The springs 82 and 83 interacting with the surface fibers provide the skeletal framework of the seal 78, which expands sufficiently in the circumferential direction to permit the expansion member 41 to form a smooth transition between maximum expansion at a medial portion of the probe and no expansion at the lower end 74 of the member 41. The springs 82 and 83 also exert a high restoring force which contracts the seal 78 after inflation and returns the seal assembly to the quiescent state of FIG. 8.

Embedded in the seal body are a plurality of internal anchor reinforcing members 90, formed of hard steel, each comprising a pair of disk-like cylindrical members 91 spaced apart axially and joined by a rod member 92 extending axially therebetween. The internal anchors 90 are disposed parallel to the axis of the probe and arrayed in tight equal spacing about the body of the seal assembly. The internal anchors prevent extrusion of the urethane material from the seal assembly, while accommodating inflation of the end portion of the expansion sleeve. Moreover, the like outer ends of the internal anchors 90 are disposed within the taper 73 of the end cap, so that they may pivot outwardly therefrom to accommodate expansion sleeve inflation while preventing blowout or rupture of the sleeve itself by anchoring themselves upon the borehole wall surface.

The method of the invention includes establishing a network of monitoring stations 101, each including a probe assembly 103 disposed in a borehole. The monitoring stations are arrayed at a recognized fault zone, preferably along both sides of a locked section of the fault, as shown for example in FIG. 4. Each borehole is initially examined by taking readings at incrementally increasing depths (for example, every 100 m) to determine the saturation depth and inversion depth and clarify the window of observation for each borehole.

Thereafter, each monitoring station is operated periodically (for example, once each day) to take readings and assess the principle maximum and minimum lateral stress vectors at each borehole. This data is transmitted to a central facility, where stress maps such as those in FIGS. 3, 4 5, and 6 may be constructed. Changes in the underground stress field are noted over time, and the build-up and release of stress energy is monitored with respect to the maximum possible shear stress level calculated for the locked section of the fault, as indicated in FIG. 7.

As stress levels reach the maximum possible level, and the measured stress vectors begin to change more rapidly, a forecast may be made of an impending earthquake at the locked section. During this period, it may be useful to take readings with greater frequency (several times per day), and to take readings at various depths in each borehole to develop a three-dimensional model of the stress field surrounding the locked fault section. Ultimately, it will be possible to provide a warning of impending earthquake within days of the event whenever a sharp excursion of stress buildup starts to occur. More specifically, an excursion of shallow tectonic stress generates piezo-electric effects such as earth current electrophoresis currents and polarization or static charge build-up and electromagnetic noise generation, which may be detected as side effects. Naturally, all the earthquake related phenomena should be related to the stress excursion in a comprehensive prospective with the engineering accuracy. Then, precautions and safety measures may be taken to minimize loss of life and property damage. Although earthquakes cannot be prevented, their devastating consequences can be ameliorated to a great degree by such an accurate forecast.

The method of the invention may also be employed to detect fault planes or fault systems that may have been previously undetected due to such factors as long dormancy periods, active surface geological processes that obscure superficial fault traces, poor historical records, and the like. A network of borehole probes constructed as described herein and operated in accordance with the method of the invention may be used to obtain and record data which discloses an accurate plot of the lateral stress field within the rock media in the area of the borehole installations. Graphical analysis of the lateral stress field, as in FIGS. 2, 3, 4, and 5, may reveal by inspection the stress field anomalies indicative of underground faults, even though there may be no surface geological evidence of the faults.

The invention claimed is:

1. A system for predicting shallow earthquakes by monitoring earthquake-producing underground stresses surrounding an earthquake fault plane, including:

a plurality of monitoring stations arrayed along said fault plane on opposed sides of said fault plane;

each of said monitoring stations including a borehole extending to a depth within the depth window of observation, and borehole probe means adapted to reside in said borehole and reiteratively and periodically measure and resolve lateral tectonic stress vectors in the rock media surrounding said borehole;

telecommunication means for transmitting the measurements of lateral tectonic stress vectors from said plurality of monitoring stations to a data collection center; and means for processing said measurements to monitor changes in the magnitude and direction of the lateral stress vector field surrounding the fault plane, comparing the lateral stress vector field to the intrinsic strength of the rock media materials and known geologic structure of the fault plane in quantitative terms, and indicating an impending occurrence of a major earthquake along the fault plane when said lateral stress vector field exceeds said intrinsic strength.

2. The system for predicting shallow earthquakes by monitoring earthquake-producing underground stresses of claim 1, wherein said borehole probe means includes a set of at least three single fracture expansion probes, each adapted to expand radially outwardly from a respective datum plane and impinge on the borehole wall, wherein the respective datum planes of each of said set of single fracture expansion probes intersect the axis of the borehole and are arrayed at diverging predetermined azimuthal angles about said axis.

3. The system for predicting shallow earthquakes by monitoring earthquake-producing underground stresses of claim 2, wherein said borehole probe means includes an anchor unit for rotationally anchoring said borehole probe means with respect to said borehole wall such that the borehole probe maintains a fixed azimuthal angle about said borehole axis, and means for supporting said plurality of single fracture expansion probes in depending relationship from said anchor unit, said means for supporting said plurality of single fracture expansion probes including a rotator neck assembly for rotating said plurality of single fracture expansion probes with respect to said anchor means to any selected angle about said borehole axis.

4. The system for predicting shallow earthquakes by monitoring earthquake-producing underground stresses of claim 3, further including means for suspending said borehole probe means within said borehole and translating said borehole probe vertically to any selected depth within said borehole, said means for suspending including a wireline extending down said borehole to said anchor unit to provide data and control communication to said borehole probe means and to support the weight of said borehole probe means.

5. The system for predicting shallow earthquakes monitoring earthquake-producing underground stresses of claim 2, wherein said borehole probe means further includes a multiple fracture expansion probe.

6. The system for predicting shallow earthquakes by monitoring earthquake-producing underground stresses of claim 3, wherein said anchor unit includes a plurality of caliper assemblies, each caliper assembly including a pair of head members extending diametrically from said anchor unit, and resilient means for biasing said pair of head members towards a deployment position to protrude and contact the borehole wall.

7. The system for predicting shallow earthquakes by monitoring earthquake-producing underground stresses of claim 6, further including LVDT means operatively associated with said caliper assemblies for automatically measuring and recording the diameter of said borehole during vertical movement of said probe.

8. The system for predicting shallow earthquakes by monitoring earthquake-producing underground stresses of claim 2, wherein each of said plurality of single fracture probes includes a central mandrel having an axial bore extending therethrough, a flexible, elastic expansion sleeve member surrounding said mandrel and inflatable by fluid pressure provided through said axial bore;

a pair of semi-cylindrical friction members secured about said expansion sleeve member and confronting along a datum plane that extends through the axis of the mandrel, whereby said expansion sleeve member inflates outwardly to fracture the borehole wall along the datum plane;

a pair of end caps joined to said mandrel for securing and containing opposed ends of said expansion sleeve member;

a pair of seal assemblies, each disposed between one of said end caps and a respective end of said expansion sleeve member, each seal assembly including an annular tapered body formed of elastic polymer; and, a plurality of internal anchor members embedded in said body and extending generally parallel to the axis of said mandrel.

9. The system for predicting shallow earthquakes by monitoring earthquake-producing underground stresses of claim 8, wherein each of said internal anchor members are formed of high strength steel, each of said internal anchor members including a pair of generally cylindrical, disk-like members spaced apart axially and joined by a rod member extending generally axially therebetween, said plurality of internal anchor members arrayed in closely adjacent order and in equal-angular spacing about said body of said seal assembly.

10. The system for predicting shallow earthquakes by monitoring earthquake-producing underground stresses of claim 1, wherein said telecommunication means includes means for operating said borehole probe means upon command from said data collection center.

11. The system for predicting shallow earthquakes by monitoring earthquake-producing underground stresses of claim 1, wherein said depth window of observation is disposed generally between the lateral stress saturation depth and the inversion depth of the rock media surrounding each borehole.

12. An improved single fracture expansion probe for measuring and resolving lateral stresses in rock media surrounding a borehole, including:

a central mandrel having an axial bore extending therethrough;

a flexible, elastic expansion sleeve member surrounding said mandrel and inflatable by fluid pressure provided through said axial bore or deflatable by removal of fluid pressure through said axial bore;

a pair of semi-cylindrical friction members secured about said expansion sleeve member and confronting along a datum plane, said datum plane extending through the axis of the mandrel and the lines of confrontation of said pair of semi-cylindrical friction members, whereby said expansion sleeve member inflates radially outwardly to fracture the borehole wall along a datum plane at a predetermined depth in the borehole;

means for measuring diametrical changes of said expansion sleeve member from said datum plane during inflation and deflation operations of said probe;

a pair of seal assemblies, each disposed between one of said end caps and a respective end of said expansion sleeve member, each seal assembly including an annular tapered body formed of elastic polymer; and, a plurality of internal anchor members embedded in said annular body of each seal assembly and extending generally parallel to the axis of said mandrel, each internal anchor member including a pair of generally cylindrical, disk-like members spaced apart axially and joined by a rod member extending generally axially therebetween.

13. The improved single fracture expansion probe of claim 12, wherein said plurality of internal anchor members are arrayed with a closely adjacent order and equal-angular spacing about said body of said seal assembly.

14. A method for predicting shallow earthquakes by measuring and monitoring underground stresses surrounding an earthquake fault plane, comprising the steps of:

drilling a plurality of boreholes in an array extending along and straddling the surface trace of an earthquake fault plane;

installing a borehole probe assembly at a preselected depth in each borehole, each borehole probe assembly including expansion probes adapted to measure and resolve the lateral stress vectors in the rock media surrounding the probe assembly at said preselected depth;

transmitting the lateral stress vector data from each borehole to a data collection center;

compiling and processing the lateral stress vector data from all the borehole probe assemblies to determine the lateral stress vector field surrounding the earthquake fault plane; and, detecting lateral stress vector field anomalies indicative of an impending earthquake.

15. The method of claim 14, further including the step of initially operating each borehole probe assembly at incrementally increasing depths in the respective borehole to determine the saturation depth and inversion depth and thereby define, locate, and clarify the subterranean window of observation for each borehole, and thereafter maintaining each borehole probe assembly within the respective window of observation.

16. The method of claim 15, further including the step of operating the borehole probe assemblies periodically and reiteratively and automatically to detect changes in the lateral stress vector field at each borehole, and collecting and processing data on the changes in the lateral stress field vectors from said borehole probe assemblies to monitor time-dependent increases in the lateral stress field surrounding the earthquake fault plane.

17. The method of claim 15, further including the step of analyzing the collected and processed data from the borehole probe assemblies, determining the principal maximum and minimum stress vector field and the maximum stresses surrounding the earthquake fault plane, and comparing these values quantitatively to the intrinsic strength of the materials and structure of the earthquake fault plane to forecast an impending major earthquake.

18. The method of claim 14, further including the step of recording time-dependent tectonic stresses at various depths within the depth window of observation in said plurality of boreholes to calculate the depth of an epicenter location of a forthcoming earthquake.

19. The method of claim 14, further including the step of analyzing the lateral stress field data to detect lateral stress field anomalies that disclose the existence of a previously unidentified fault in the rock media in the adjacent area of said plurality of boreholes.

* * * * *